US011142827B2

(12) United States Patent
Riesop et al.

(10) Patent No.: US 11,142,827 B2
(45) Date of Patent: Oct. 12, 2021

(54) FLUORIDE-FREE ZIRCONIUM-BASED METAL PRE-TREATMENT FOR PASSIVATION

(71) Applicant: Henkel AG & Co. KGaA, Duesseldorf (DE)

(72) Inventors: Joerg Riesop, Kerpen (DE); Volker Geick, Grevenbroich (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 345 days.

(21) Appl. No.: 16/106,759

(22) Filed: Aug. 21, 2018

(65) Prior Publication Data

US 2019/0010610 A1 Jan. 10, 2019

Related U.S. Application Data

(63) Continuation of application No. PCT/EP2017/051291, filed on Jan. 23, 2017.

(30) Foreign Application Priority Data

Mar. 8, 2016 (DE) ..... 102016203771.4

(51) Int. Cl.

| | |
|---|---|
| ***C23C 22/05*** | (2006.01) |
| ***C23C 22/34*** | (2006.01) |
| ***C23C 22/56*** | (2006.01) |
| ***C23C 22/53*** | (2006.01) |
| ***C23C 22/48*** | (2006.01) |
| ***B21D 28/00*** | (2006.01) |
| ***C23F 11/04*** | (2006.01) |
| *C23C 22/50* | (2006.01) |

(52) U.S. Cl.

CPC ..... *C23C 22/56* (2013.01); *B21D 28/00* (2013.01); *C23C 22/34* (2013.01); *C23C 22/48* (2013.01); *C23C 22/53* (2013.01); *C23F 11/04* (2013.01)

(58) Field of Classification Search

CPC ..... C23C 22/34; C23C 22/361

See application file for complete search history.

(56) References Cited

U.S. PATENT DOCUMENTS

| | | | | |
|---|---|---|---|---|
| 6,464,800 | B1 * | 10/2002 | Carlson | C23C 22/34 148/244 |
| 2004/0137246 | A1 | 7/2004 | Fristad et al. | |
| 2015/0218407 | A1 | 8/2015 | Bao et al. | |

FOREIGN PATENT DOCUMENTS

| | | | |
|---|---|---|---|
| DE | 19933186 | A1 | 1/2001 |
| EP | 1455002 | A1 | 9/2004 |
| JP | 2002275648 | A | 9/2002 |
| WO | 0026437 | A1 | 5/2000 |
| WO | 2011002040 | A1 | 12/2012 |

OTHER PUBLICATIONS

International Search Report for PCT/EP2017/051291 dated Apr. 20, 2017.

Hendrik Theodorus Rijnten, "Zirconia", Nijmegen: Janssen N.V., 1971.

* cited by examiner

*Primary Examiner* — Lois L Zheng

(74) *Attorney, Agent, or Firm* — Mary K. Cameron

(57) ABSTRACT

A method for anti-corrosion pre-treatment of metal substrates using zirconium-based aqueous anti-corrosion agents comprising polycyclic hydrocarbons that have at least one anellated benzene ring, each having at least two ring-substituted hydroxyl groups in ortho position to each other. The aqueous anti-corrosion agent can be substantially free both of passivating chromium-containing compounds and of fluoride-containing compounds that pickle the metal substrate. Pre-treatment by drying (dry-in-place method) is especially advantageous. Accordingly, the method according to the invention is suitable in particular for the pre-treatment of metal strip, wherein excellent anti-corrosion results are achieved on surfaces of aluminum or steel. The invention further relates to a method for producing coated can lids from aluminum strip by using the previously mentioned zirconium-based anti-corrosion agent. A further aspect comprises an aqueous concentrate for providing the ready-to-use anti-corrosion agents.

19 Claims, No Drawings

FLUORIDE-FREE ZIRCONIUM-BASED METAL PRE-TREATMENT FOR PASSIVATION

The present invention relates to a method for the anti-corrosion pretreatment of metal substrates using zirconium-based aqueous anti-corrosion agents. The anti-corrosion effect of the zirconium-based agent relies on the presence of polycyclic hydrocarbons that have at least one anellated benzene ring having in each case at least two hydroxyl groups substituted in the ring in the ortho position relative to one another. The aqueous anti-corrosion agent can be substantially free of both passivating chromium-containing compounds and fluoride-containing compounds that have a pickling effect on the metal substrate. Pretreatment by means of drying (dry-in-place method) is particularly advantageous according to the invention. Accordingly, the method according to the invention is particularly suitable for the pretreatment of strip metal, excellent anti-corrosion results being achieved on aluminum or steel surfaces. The invention further comprises a method for producing coated can lids from strip aluminum using the aforementioned zirconium-based anti-corrosion agent. A further aspect comprises an aqueous concentrate for providing the ready-to-use anti-corrosion agents.

The conversion treatment of metal surfaces in order to provide an anti-corrosion coating based on aqueous compositions containing water-soluble compounds of the element zirconium is a technical field that has been extensively described in the patent literature. For improving the profile of properties of conversion treatments of this kind in terms of protection from corrosion and promotion of adequate paint adhesion, a wide range of variants of metal pretreatment of this kind are known which aim to make up the agents that bring about conversion, or involve additional wet-chemical treatment steps directly linked to the conversion treatment.

In this context, diverse method variants for providing the passivating coating are also known in principle, drying said coating after applying a defined wet film always providing for pretreatment involving as few steps as possible and, in this respect, playing a vital role from a technical point of view.

Applying aqueous anti-corrosion agents by drying a wet film is fundamentally a process that is completely established and used in practice. For this purpose, a roller-application method, for example, can be found in DE 199 33 186 A1 that makes it possible to apply a defined wet film of conventional aqueous anti-corrosion agents based on fluoro complexes of the elements zirconium and/or titanium to flat products, and to dry said film in a controlled manner. However, the coatings obtained by drying a wet film differ to a great extent, in terms of the morphological and chemical structure thereof, from the conventional conversion layers that can be obtained by dip or spray application after removal of the wet film of the anti-corrosion agent adhering to the metal substrate. During the drying process, all of the active components of the anti-corrosion agent that do not transition into the gaseous state during drying are usually deposited on the metal substrate. Therefore, these components include not only all of the non-volatile compounds of the elements provided for the passive layer, for example oxides/hydroxides or phosphates of the element zirconium, but also all of the non-volatile active components of the anti-corrosion agent and intermediate stages of said elements which, in the case of water-soluble fluoro complexes of the element zirconium as active components of the anti-corrosion agent, cause there to be a considerable proportion of fluoride in the dried coating. However, it is exactly these active components and intermediate stages which have not been completely transformed and have become constituents of the dried coating that usually result in poor anti-corrosion properties or the need for post-treatment. In this connection, EP 1 455 002 A1 specifies, for example, that the proportion of fluorides in the passivating coating produced by wet-chemical conversion by means of water-soluble fluoro compounds of the element zirconium should not exceed a certain proportion, and at the same time proposes, as suitable post-treatments, drying at an elevated temperature and rinsing with an alkaline solution in order to bring about a significant reduction in the proportion of fluoride.

Therefore, there is also a need to provide a method for the anti-corrosion pretreatment of metal substrates which is as technically efficient as possible in terms of the number of method steps required, and in which the focus is on the passivating effect of compounds of the element zirconium. In this case, it is particularly important to provide an anti-corrosion agent of this kind which produces excellent results just by being applied and dried (dry-in-place method). Excellent results are achieved if the application in the dry-in-place method produces coatings which, in addition to providing temporary protection from corrosion, develop excellent protection from corrosive disbonding when in interaction with subsequently applied primer coatings based on film-forming organic resins. In the present case, it is particularly desirable for drying of the anti-corrosion agent to make said agent suitable for producing an effective paint base on aluminum substrates and thus for being used to produce drinks cans. Advantageously, the anti-corrosion agent to be applied in a method of this kind is also largely free of fluoride-releasing compounds, which are problematic in terms of environmental protection.

This range of problems is solved by a method for the anti-corrosion pretreatment of a metal substrate, in which method the surface of the metal substrate is brought into contact with an aqueous anti-corrosion agent which contains at least one water-soluble compound (A) of the element zirconium, the agent additionally containing at least one polycyclic hydrocarbon (B) which comprises at least one anellated benzene ring having in each case at least two hydroxyl groups substituted in the ring in the ortho position relative to one another.

In the context of the present invention, a compound (A) of the element zirconium is water-soluble if it has a solubility of at least 0.1 g of the compound, based on the element zirconium, per kilogram of the resulting aqueous solution at 20° C. in deionized water having a specific conductance of less than 1 $\mu Scm^{-1}$.

In the method according to the invention, it is ensured that, following pickling action on the metal substrate, the metal substrate is passivated by a surface coating based on poorly soluble compounds of the element zirconium and the polycyclic hydrocarbon. Furthermore, metal substrates which are pretreated according to the invention and thus have a corresponding surface coating are extremely suitable for producing an excellent paint base for subsequent primers containing film-forming organic resins; for this purpose, the aqueous anti-corrosion agent can additionally contain organic polymers, without this having a negative impact on passivation.

In order to achieve effective passivation, which is additionally not negatively affected by the presence of organic polymers which improve paint adhesion, it is particularly advantageous for the polycyclic hydrocarbon (B) to have low solubility in water, such that the amount of dissolved polycyclic hydrocarbon (B) necessary for ensuring adequate surface coating in the relevant application method is ideally only just dissolved in the aqueous anti-corrosion agent. In this connection, methods according to the invention are preferred in which the polycyclic hydrocarbon (B) has a solubility of less than 5 g, particularly preferably less than 1 g, per kilogram of the resulting aqueous solution at 20° C. in deionized water having a specific conductance of less than 1 $\mu Scm^{-1}$. Such a low solubility of the polycyclic hydrocarbon (B) is particularly advantageous when the anti-corrosion agent is applied in the drying method (dry-in-place method) in which even low amounts of the active components of the anti-corrosion agent may be adequate for producing a passivating surface coating on the metal substrate to be protected. With regard to compound (B), the term "solubility" is understood to mean that, above the mentioned solubility limits at a shear rate of 100 $s^{-1}$, dispersions or emulsions are produced that have an average particle diameter (D50 value) of greater than 50 nm, as calculated from cumulative particle diameter distribution curves determined by means of dynamic light scattering methods.

In a preferred embodiment of the method according to the invention, the polycyclic hydrocarbon (B) contains at least two anellated benzene rings each having at least two hydroxyl groups substituted in the ring in the ortho position relative to one another, the benzene rings being bridged in each case by being anellated on an acyclic hydrocarbon system, the acyclic hydrocarbon system preferably comprising at least one oxo group or hydroxyl group. A person skilled in the art is familiar with polycyclic hydrocarbons (B) of this kind, for example in the form of haematoxylin and its oxidation product hematein, and in the form of alizarin.

A particularly homogenous surface coating based on the element zirconium, and thus also passivation, is achieved if the pretreatment according to the invention is carried out in the presence of polycyclic hydrocarbons (B) which are formed on the anthraquinone backbone. Accordingly, in methods according to the invention, polycyclic hydrocarbons (B) are preferred which are selected from the group of anthraquinones which are substituted in the ring by at least two hydroxyl groups in the ortho position relative to one another, particularly preferably selected from the group consisting of 1,2-dihydroxyanthraquinone, 3,4-dihydroxyanthraquinone, 1,2,3-trihydroxyanthraquinone, 1,2,4-trihydroxyanthraquinone, 1,2,3-trihydroxyanthraquinone, 1,2,5-trihydroxyanthraquinone, 1,2,6-trihydroxyanthraquinone, 1,2,7-trihydroxyanthraquinone, 1,2,8-trihydroxyanthraquinone, 1,2,3-trihydroxyanthraquinone, 1,3,4-trihydroxyanthraquinone, 1,4,5-trihydroxyanthraquinone, 1,6,7-trihydroxyanthraquinone, 1,2,5,8-tetrahydroxyanthraquinone, 1,2,5,8-tetrahydroxyanthraquinone 1,4,5,8-tetrahydroxyanthraquinone, 1,2,3,4-tetrahydroxyanthraquinone; the polycyclic hydrocarbon (B) is particularly preferably selected from 1,2-hydroxyanthraquinone.

Furthermore, the ratio of water-soluble compounds (A) of the element zirconium to polycyclic hydrocarbons (B) should be within a particular range in order for the surfaces of the metal substrates pretreated in the method according to the invention to be optimally passivated. Preferably, the weight ratio of water-soluble compounds (A) of the element zirconium, based on the element zirconium, to polycyclic hydrocarbons (B) in the anti-corrosion agent of the method according to the invention is less than 0.2, particularly preferably less than 0.1, but preferably greater than 0.02.

Preferred amounts of the polycyclic hydrocarbons (B) in the anti-corrosion agent of the method according to the invention are in the range of from 5 to 250 mg/kg.

The anti-corrosion agent used in methods according to the invention is preferably acidic for increased solubility of the water-soluble compounds (A) of the element zirconium and for a pickling effect on the metal substrate. In a preferred embodiment of the method according to the invention, the pH of the anti-corrosion agent is less than 2.0, particularly preferably less than 1.6, but preferably greater than 0.5, particularly preferably greater than 1.0.

The method according to the invention is distinguished in that a high degree of removal by pickling, i.e. a high rate of metal dissolution, during the process of bringing the substrate into contact with the anti-corrosion agent is not necessary in order to achieve adequate surface passivation. As a consequence, in particularly advantageous embodiments of the invention, the anti-corrosion agent can be formulated so as to be largely free of fluorides or fluoride-releasing compounds, which are usually used to increase the pickling rate, in particular on aluminum substrates, and are of concern in terms of environmental protection.

Accordingly, according to the invention, methods are preferred for which the molar ratio of zirconium to the total fluoride content in the homogenous aqueous phase of the anti-corrosion agent is greater than 1, preferably greater than 2, particularly preferably greater than 4. The total fluoride content is determined using a fluoride-sensitive electrode in a TISAB-buffered aliquot portion of the anti-corrosion agent at 20° C. (TISAB: "Total Ionic Strength Adjustment Buffer"), the mixture ratio of buffer to the aliquot portion of the anti-corrosion agent by volume being 1:1. The TISAB buffer is prepared by dissolving 58 g NaCl, 1 g sodium citrate and 50 ml glacial acetic acid in 500 ml deionized water ($K<1$ $\mu Scm^{-1}$), setting a pH of 5.3 using 5 N NaOH and filling to a total volume of 1000 ml, again with deionized water ($K<1$ $\mu Scm^{-1}$).

Furthermore, in this connection, it is preferable according to the invention for the source of the water-soluble compound (A) of the element zirconium to not additionally be a source of fluoride-ions, and to preferably be selected from zirconyl nitrate, zirconium acetate and/or ammonium zirconium carbonate, particularly preferably zirconyl nitrate.

The preferred amount of the water-soluble compound (A) in the anti-corrosion agent of the method according to the invention is at least 40 mg/kg, particularly preferably at least 200 mg/kg, in particular at least 400 mg/kg, but preferably no greater than 4000 mg/kg, based in each case on the amount of the element zirconium.

In a particularly preferred embodiment of the method according to the invention, the total fluoride content in the aqueous phase of the anti-corrosion agent is less than 50 g/kg, preferably less than 10 mg/kg, particularly preferably less than 1 mg/kg, based in each case on the anti-corrosion agent.

The present invention is also advantageous from an ecological point of view in that the anti-corrosion agent does not have to contain any poorly soluble salt-forming anions, such as phosphates, in order to form a passivating coating. In a preferred embodiment of the method according to the invention, less than 0.2 wt. %, particularly preferably less than 0.1 wt. %, of dissolved phosphates, calculated as $PO_4$, are therefore contained in the anti-corrosion agent.

The method according to the invention is extremely suitable for providing a paint base on metal substrates, in particular by drying a wet film of the anti-corrosion agent. This suitability means that the presence of organic polymers that improve paint adhesion in the aqueous anti-corrosion agent does not have a negative impact on passivation. In a preferred embodiment of the method according to the invention, in which organic polymers are used to further improve paint adhesion, at least 0.1 wt. %, particularly preferably at least 0.2 wt. %, of organic compounds (C) having a molar mass of above 5,000 g/mol, based in each case on the aqueous anti-corrosion agent, are therefore contained in the anti-corrosion agent. In the present case, the molar mass can be determined directly in the anti-corrosion agent at 20° C. by means of gel permeation chromatography using a concentration-dependent detector, molar mass distribution curves calibrated against pullulan standards being used. The organic compounds (C) preferably contain at least in part functional groups selected from hydroxyl groups, carboxyl groups, phosphate groups, phosphonate groups and amino groups. In a particularly preferred embodiment, the sum of the acid number and hydroxyl number is at least 100 milligrams KOH per gram, particularly preferably at least 200 milligrams KOH per gram, of organic compounds (C), but preferably no greater than 600 milligrams KOH per gram of organic compounds (C).

According to the invention, the acid number is a measured variable which is to be determined experimentally and is a measure of the number of free acid groups in the polymer or in a polymer mixture. The acid number is determined by a weighed amount of the polymer or polymer mixture being dissolved in a solvent mixture consisting of methanol and distilled water in a volume ratio of 3:1 and then being potentiometrically titrated in methanol using 0.05 mol/l KOH. The potentiometric measurement is carried out using a combination electrode (LL-Solvotrode® from Metrohm; reference electrolyte: 0.4 mol/l tetraethylammonium bromide in ethylene glycol). In this case, the acid number corresponds to the amount of KOH added in milligrams per gram of polymer or polymer mixture at the inflection point of the potentiometric titration curve.

Similarly, according to the invention, the hydroxyl number can be experimentally determined as a measure of the number of free hydroxyl groups in the polymer or in a polymer mixture by means of potentiometric titration. For this purpose, a weighed amount of the polymer or polymer mixture in a reaction solution of 0.1 mol/l of phthalic acid anhydride is heated in pyridine at 130° C. for 45 minutes and mixed firstly with pyridine in a volume that is 1.5 times the volume of the reaction solution and then with deionized water ($K<1\ \mu Scm^{-1}$) in a volume that is 1.5 times the volume of the reaction solution. The released amount of phthalic acid is titrated in this mixture by means of 1 M of potassium hydroxide solution. The potentiometric measurement is carried out using a combination electrode (LL-Solvotrode® from Metrohm; reference electrolyte: 0.4 mol/l tetraethylammonium bromide in ethylene glycol). In this case, the hydroxyl number corresponds to the amount of KOH added in milligrams per gram of polymer or polymer mixture at the inflection point of the potentiometric titration curve.

Particularly for the pretreatment of aluminum in the dry-in-place method, according to the invention, aqueous anti-corrosion agents are preferred which contain, as organic compounds (C), copolymers or copolymer mixtures of alkenes and vinyl alcohol, particularly preferably of ethene and vinyl alcohol, which particularly preferably have a hydroxyl number in the range of from 200 to 500 milligrams KOH per gram of copolymer or copolymer mixture. The proportion of these copolymers or copolymer mixtures is preferably at least 0.1 wt. %, particularly preferably at least 0.2 wt. %, but preferably does not exceed 5 wt. %, particularly preferably does not exceed 2 wt. %, based in each case on the aqueous anti-corrosion agent.

The presence of particulate constituents, for example anti-corrosion pigments, in the anti-corrosion agent does not offer any significant advantages in terms of further passivation, and is instead detrimental to the formation of homogenous thin coatings in the method according to the invention. Accordingly, methods according to the invention are preferred in which less than 0.1 wt. %, particularly preferably less than 0.01 wt. %, of particulate inorganic constituents that remain in the retentate during ultrafiltration with a cut-off of 50 kD are contained in the anti-corrosion agent.

The present invention is also advantageous in that the aqueous anti-corrosion agent can be formulated so as to be substantially free of toxic heavy metals. The aqueous anti-corrosion agent therefore contains, in a preferred embodiment, less than 50 mg/kg, preferably less than 10 mg/kg, particularly preferably less than 10 mg/kg, of compounds of the element chromium and, in another preferred embodiment, less than 50 mg/kg, preferably less than 10 mg/kg, particularly preferably less than 1 mg/kg, of compounds of the elements chromium, nickel and cobalt.

The metal substrates pretreated in the method according to the invention should have, in the aqueous anti-corrosion agent, an adequate solution pressure under technically conventional conditions with respect to acids and atmospheric oxygen, and thus corrode at least to such an extent that the process of converting the natural thin oxide layer on the particular metal substrate or the thin oxide layer specifically provided on said metal substrate by means of wet-chemical cleaning is initiated, and ends when elements and compounds of the active components of the anti-corrosion agent are deposited.

Therefore, according to the invention, the pretreatment of metal substrates having a corrosion potential of less than +0.2 V (SHE) in a potassium hydrogen phthalate buffer saturated with oxygen (0.05 mol/l, pH 4.01, 20° C., 0.21 bar oxygen partial pressure in the atmosphere) is preferred.

In a particular embodiment of the method according to the invention, the metal substrates are selected from zinc and/or aluminum and the alloys thereof, particularly preferably from aluminum and the alloys thereof. In the context of the present invention, alloys are formed from metal substrates which contain the relevant metal element in a proportion of at least 50 at. %. On substrates of the metal aluminum, particularly effective and homogenous passivation of the aluminum material can be observed in the method according to the invention, which passivation occurs almost irrespective of the form of application and is usually completed such that it results in excellent adhesion for subsequently applied primers containing at least one curable film-forming organic resin, in particular if the film-forming resin comprises functional groups capable of condensation selected from phosphonic acid, phosphoric acid, oxirane, amino, hydroxyl and/or carboxyl groups.

The anti-corrosion agent can be brought into contact with the metal substrate by means of conventional methods known to a person skilled in the art of surface treatment. However, a form of application preferred according to the invention is the positioning of a defined wet film on the surface of a preferably planar metal substrate, for example in the roller-application method or by spraying and wiping, and drying of said wet film, such that the active components of the anti-corrosion agent remain on the metal substrate in reproducible amounts that are always sufficient for passivation.

In this respect, according to the invention, a method is preferred in which, after the metal substrate has been brought into contact with the aqueous anti-corrosion agent, a wet film of the anti-corrosion agent remains on the surface of the metal substrate and is dried (dry-in-place method), preferably by supplying heat, before a subsequent rinsing step or subsequent wet-chemical treatment. Drying can be carried out using all technical means which result in the liquid constituents of the wet film having a melting point at 1 bar of no greater than 150° C. migrating into the surrounding atmosphere. Therefore, as an alternative to the film being dried by supplying heat, said film can also be dried by passing a dry air stream thereover. In the context of the present invention, wet-chemical treatment is any treatment of the substrate with an agent containing water of which the purpose is not simply to remove active components contained in a wet film and stemming from a previous treatment step from the surface of the metal substrate.

Furthermore, in order to achieve adequate passivation, in particular on the substrates zinc and/or aluminum and the alloys thereof, according to the invention, it is preferable for the wet film of the anti-corrosion agent to remain on the metal substrate with a film thickness which produces, after drying, a coating layer of zirconium of greater than 5 $mg/m^2$, preferably greater than 10 $mg/m^2$, but preferably less than 150 $mg/m^2$, particularly preferably less than 50 $mg/m^2$.

The particular suitability of the method according to the invention for aluminum and the alloys thereof in combination with the preferred application of the anti-corrosion agent by said agent being applied and drying out immediately thereafter makes the method according to the invention particularly attractive for the provision of pretreated strip aluminum. A particular embodiment of the method according to the invention is therefore used to produce coated can lids from strip aluminum, wherein, in order to produce said lids, a wet film of an aqueous anti-corrosion agent containing at least one water-soluble compound (A) of the element zirconium and at least one polycyclic hydrocarbon (B) that comprises at least one anellated benzene ring having in each case at least two hydroxyl groups substituted in the ring in the ortho position relative to one another is applied, in a first step, to strip aluminum, which wet film produces, after drying, a coating layer of zirconium of greater than 5 $mg/m^2$, whereupon, after drying, the lid material is punched out of the strip and shaped into can lids. According to the invention, after drying, but preferably before the shaping to form lid material, an organic coating is preferably applied and cured by means of a primer containing at least one curable film-forming organic resin which in turn preferably comprises functional groups capable of condensation selected from phosphonic acid, phosphoric acid, oxirane, amino, hydroxyl and/or carboxyl groups. In the present case, a primer is understood to mean an agent for providing, on the metal substrates pretreated according to the invention with the anti-corrosion agent, the first coating consisting of an organic material which necessarily contains as such at least one curable film-forming organic resin. When the first coating is provided by means of the primer, layer thicknesses in the range of from 0.5 to 50 μm are usually produced.

The anti-corrosion agents that have already been described in greater detail in the context of the general method for the anti-corrosion pretreatment of a metal substrate could preferably be used similarly for the method according to the invention for producing coated can lids from strip aluminum.

In a preferred method according to the invention for producing coated can lids from strip aluminum, the primer contains a curable film-forming organic resin selected from a copolymer or copolymer mixture of at least one aliphatic and acyclic alkene with at least one □, □ unsaturated carboxylic acid in water-dispersed form, the acid number of the copolymer or copolymer mixture preferably being at least 20 mg KOH/g, but preferably no greater than 200 mg KOH/g, and the acid groups of the copolymer or copolymer mixture in water-dispersed form preferably being neutralized at least to 20%, but preferably no greater than 60%.

Alternatively, the curable film-forming organic resin of the primer is preferably selected from an acrylate dispersion which can be obtained as a reaction product of a polymer which comprises terminal or pendant ethylenically unsaturated groups and preferably has an average molar mass in the range of from 3,000 to 50,000 g/mol with a mixture of monomers comprising ethylenically unsaturated groups, including those having carboxyl groups, such as (meth) acrylic acid, itaconic acid and crotonic acid. US 2015/0218407 A1 gives a detailed description of the preparation of dispersions of this kind in paragraphs [0048]-[0049].

Owing to the decidedly effective paint adhesion that is produced by pretreatment according to the invention based on the above-described anti-corrosion agents, it is possible to dispense with specific, often epoxide-based, primers which, in the field of packaging, can emit small amounts of hormone-disrupting toxins, for example bisphenol A, to the stored food and drink, and therefore preferably should not be used. Accordingly, the primers for the first coating of the pretreated strip aluminum for producing can lids are preferably as free as possible of organic compounds which comprise a diphenyl methane structural unit and contain particularly preferably less than 0.1 wt. % of diphenyl methane structural units, calculated as $C_{15}H_{14}$ and based on the total amount of compounds having a boiling point of greater than 150° C. at 1 bar.

In a further aspect, the present invention comprises a concentrate of the above-described anti-corrosion agent, the concentrate having a pH in the range of from 0.5 to 2.0 and containing at least 1 wt. % of a water-soluble compound (A) of the element zirconium, based on the element zirconium, and at least 0.01 wt. % of polycyclic hydrocarbons (B) that have at least two anellated benzene rings having in each case at least two hydroxyl groups substituted in the ring in the ortho position relative to one another, the benzene rings being bridged in each case by being anellated on an acyclic hydrocarbon system, the acyclic hydrocarbon system preferably comprising at least one oxo group or hydroxyl group.

Naturally, the same proportions of water-soluble compounds (A) of the element zirconium and polycyclic hydrocarbons (B) relative to one another are preferred for the concentrate according to the invention as for the anti-corrosion agent provided thereby in the method according to the invention.

The concentrate optionally contains at least 1 wt. %, preferably at least 2 wt. %, but preferably no more than 20 wt. %, particularly preferably no more than 10 wt. %, of organic compounds (C) selected from copolymers or copolymer mixtures of alkenes and vinyl alcohol, preferably ethene and vinyl alcohol, which preferably each have in turn a hydroxyl number in the range of from 200 to 500 milligrams KOH per gram of copolymer or copolymer mixture.

In the concentrate according to the invention, the water-soluble compound (A) of the element zirconium is preferably selected from zirconyl nitrate.

In the concentrate according to the invention, it is also preferable for the polycyclic hydrocarbon (B) to be selected from 1,2-hydroxyanthraquinone.

The anti-corrosion agent for use in a method according to the invention can be prepared by diluting the concentrate by a factor of 5-20.

As previously noted with regard to the anti-corrosion agent in the described methods according to the invention, said agent should not contain certain components in amounts above those specified in order to ensure adequate passivation. The same also applies correspondingly to the concentrate according to the invention, the respective upper limits in the concentrate according to the invention being 5 times higher than those for the anti-corrosion agent in the method according to the invention.

PRACTICAL EXAMPLES

The effectiveness of the pretreatment according to the invention for forming a potential paint base can be verified after applying in drops a small amount (approx. 1 ml) of an acidic aqueous pretreatment solution (pH 1.5) according to the invention which contains 15 g/kg Zr in the form of zirconyl nitrate and 500 mg/kg of alizarin to an aluminum sheet (AI 3008; 0.2 mm thickness) and subsequently drying said solution out at 30° C., by comparison with a treatment involving a solution that does not contain alizarin. While the treatment according to the invention provides an iridescent coating that cannot be wiped off, the whiter coating based merely on the zirconyl nitrate-containing solution can easily be removed with a cloth.

In order to demonstrate the suitability of the pretreatment according to the invention for providing an effective paint base, various coating systems for can lids were applied and the paint adhesion, in particular lifting of paint ("feathering"), and discoloration ("blushing") after precipitation under sterilization conditions with which a coating of a material which is intended to be suitable for storing food and drink and is therefore in direct contact with food and drink must usually comply were evaluated.

Table 1 lists the various pretreatments and primer coatings which were tested in this regard. The pretreatment was carried out on thin aluminum sheets (AI 3006) that had been cleaned with an alkaline (Bonderite® C-AK 1803 from Henkel AG & Co. KGaA, 15 g/L, 60° C., 10 s), had been rinsed with deionized water ($\kappa<1\ \mu Scm^{-1}$) and had a thickness of 0.2 mm and, for this purpose, a wet film of the pretreatment solution of approx. 4-6 ml/m$^2$ was applied and dried at 80° C. such that the coating layer of zirconium was in each case 12 mg/m$^2$. The organic primer was applied by knife coating immediately after the drying step and dried out and cured at 249° C. PMT (Peak Metal Temperature), a dry film layer of primer of approx. 12 g/m$^2$ being set.

The aluminum sheets coated in this way were precipitated under sterilization conditions at 121° C. using tap water or in tap water containing 2 wt. % of citric acid for 30 minutes in each case in the autoclave. Paint adhesion at the cross-cutting according to DIN EN ISO 2409 and the "blushing", i.e. the presence of whitish discoloration, were then evaluated. The results are summarized in Table 2.

TABLE 1

| Test no. | Pretreatment | | Primer |
|---|---|---|---|
| E1 | zirconyl nitrate | 6 g/kg | epoxide dispersion[3] |
| | alizarin | 0.08 g/kg | |
| | ethylene-vinyl alcohol copolymer[1] | 4.8 g/kg | |
| E2 | zirconyl nitrate | 6 g/kg | acrylate dispersion[4] |
| | alizarin | 0.08 g/kg | |
| | ethylene-vinyl alcohol copolymer[1] | 4.8 g/kg | |
| CE1 | base: Bonderite ® MNT-802 N[2] | | epoxide dispersion[3] |
| CE2 | base: Bonderite ® MNT-802 N[2] | | acrylate dispersion[4] |

[1]degree of hydrolysis 93 mol. %
[2]10 wt. % of aqueous solution of the commercial product (Henkel AG & Co. KGaA) containing $H_2ZrF_6$ and polyacrylic acid in a weight ratio of 1.23:1
[3]2489-814 (PPG)
[4]2466-810 (PPG)

It is evident that the pretreatment according to the invention provides excellent paint adhesion values in particular for the coating based on the acrylate-based primer, by comparison with a conventional pretreatment based on fluorozirconate, whereas at least equally good results are obtained both in terms of paint adhesion and blushing for a coating based on the epoxide-based primer.

TABLE 2

| Test no. | Cross cutting[1] | | Blush[2] | |
|---|---|---|---|---|
| | Tap water | Citric acid | Tap water | Citric acid |
| E1 | 0 | 0 | 1 | 2 |
| E2 | 0 | 2 | 0 | 2 |
| CE1 | 0 | 0 | 1 | 2 |
| CE2 | 0 | 5 | 3 | 4 |

[1]according to DIN EN ISO 2409 (0-5)
[2]0: no discoloration
1: less than 10% of the surface area is discolored; individual points
2: less than 20% of the surface area is discolored; individual points
3: at least 20% of the surface area is discolored; in strips
4: at least 40% of the surface area is discolored
5: at least 60% of the surface area is discolored

The invention claimed is:

1. A method for anti-corrosion pretreatment of a metal substrate, comprising steps of:

1) contacting at least one surface of a metal substrate with an aqueous anti-corrosion agent comprising:

(A) at least one water-soluble compound of the element zirconium; and (B) at least one polycyclic hydrocarbon compound which comprises at least one anellated benzene ring, wherein the at least one anellated benzene ring has at least two hydroxyl functional groups on the ring in an ortho position relative to one another; wherein the aqueous anti-corrosion agent has a weight ratio of the water-soluble compounds (A) of the element zirconium, based on the element zirconium, to the polycyclic hydrocarbons (B) that is less than 0.2:1.

2. The method according to claim 1, wherein the at least one polycyclic hydrocarbon (B) has a solubility of less than 5 g/kg, at 20° C. in deionized water having a specific conductance of less than 1 $\mu Scm^{-1}$.

3. The method according to claim 1, wherein the at least one polycyclic hydrocarbon (B) comprises at least two of the anellated benzene rings having the at least two hydroxyl functional groups on the ring in the ortho position relative to one another; and the benzene rings being bridged in each case by being anellated on an acyclic hydrocarbon system.

4. The method according to claim 3, wherein the acyclic hydrocarbon system comprises at least one oxo group or hydroxyl group.

5. The method according to claim 1, wherein the at least one polycyclic hydrocarbon (B) is selected from anthraquinones which are substituted on the ring by at least two hydroxyl functional groups in the ortho position relative to one another.

6. The method according to claim 1, wherein the source of the at least one water-soluble compound (A) of the element zirconium is not a source of fluoride ions.

7. The method according to claim 1, wherein the at least one water-soluble compound (A) is selected from zirconyl nitrate, zirconium acetate, ammonium zirconium carbonate and combinations thereof.

8. The method according to claim 1, wherein the aqueous anti-corrosion agent comprises an aqueous phase having a total fluoride content of less than 50 g/kg.

9. The method according to claim 1, wherein the anti-corrosion agent has a pH of less than 2.0, but greater than 0.5.

10. The method according to claim 1, wherein the aqueous anti-corrosion agent further comprises organic compounds (C), different from (B), having a molar mass of greater than 5,000 g/mol, and present in an amount of at least 0.1 wt. % based in each case on the aqueous anti-corrosion agent.

11. The method according to claim 10, wherein the organic compounds (C) comprise at least in part functional groups selected from hydroxyl groups, carboxyl groups, phosphate groups, phosphonate groups and amino groups; and an acid number and a hydroxyl number which are in sum at least 100 milligrams KOH per gram, but no greater than 600 milligrams KOH per gram, of the organic compounds (C).

12. The method according to claim 11, wherein the organic compounds (C) are selected from at least one copolymer or copolymer mixture of alkenes and vinyl alcohol, having a hydroxyl number in a range of from 200 to 500 milligrams KOH per gram of copolymer or copolymer mixture.

13. The method according to claim 12, wherein the at least one copolymer or copolymer mixtures is present in an amount not exceeding 5 wt. %, based in each case on the aqueous anti-corrosion agent.

14. The method according to claim 1, wherein the metal substrates are selected from zinc and/or aluminum.

15. The method according to claim 1 wherein after contacting the metal substrate with the aqueous anti-corrosion agent, a wet film remains on the at least one surface of the metal substrate and the contacting step 1) is followed by a drying step 2), before a subsequent rinsing step or subsequent wet-chemical treatment.

16. The method according to claim 15, wherein the wet film has a film thickness which produces, after drying, a coating layer of greater than 5 $mg/m^2$, but less than 150 $mg/m^2$, measured as zirconium.

17. A method for producing coated can lids from strip aluminum, comprising steps of:

a) in a first step, applying to strip aluminum a coating layer of greater than 5 $mg/m^2$, measured as zirconium, according to the method of claim 1;

b) optionally, applying and curing a primer;

c) after step a) punching a lid material out of the strip aluminum; and d) shaping the lid material into can lids.

18. A method for anti-corrosion pretreatment of a metal substrate, comprising steps of:

1) contacting at least one surface of a metal substrate with an aqueous anti-corrosion agent comprising:

(A) at least one water-soluble compound of the element zirconium; and (B) at least one polycyclic hydrocarbon compound which comprises at least one anellated benzene ring, wherein the at least one anellated benzene ring has at least two hydroxyl functional groups on the ring in an ortho position relative to one another;

wherein the aqueous anti-corrosion agent comprises a homogenous aqueous phase having a molar ratio of the element zirconium to total fluoride that is greater than 1.

19. A concentrate of an anti-corrosion agent comprising: at least 1 wt. % of a water-soluble compound of the element zirconium, based on the element zirconium; and at least 0.01 wt. % of at least one polycyclic hydrocarbon compound which comprises at least one anellated benzene ring, wherein the at least one anellated benzene ring has at least two hydroxyl functional groups on the ring in an ortho position relative to one another, wherein the at least one anellated benzene rings are bridged in each case by being anellated on an acyclic hydrocarbon system; wherein the aqueous anti-corrosion agent has a weight ratio of the water-soluble compounds (A) of the element zirconium, based on the element zirconium, to the polycyclic hydrocarbons (B) that is less than 0.2:1; and wherein the concentrate has a pH in a range of from 0.5 to 2.0.

* * * * *